US005195906A

United States Patent [19]

Szegda

[11] Patent Number: 5,195,906

[45] Date of Patent: Mar. 23, 1993

[54] COAXIAL CABLE END CONNECTOR

[75] Inventor: Andrew Szegda, Canastota, N.Y.

[73] Assignee: Production Products Company

[21] Appl. No.: 815,062

[22] Filed: Dec. 27, 1991

[51] Int. Cl.[5] ..... H01R 4/24

[52] U.S. Cl. ..... 439/394; 439/578

[58] Field of Search ..... 439/394, 578–585

[56] References Cited

U.S. PATENT DOCUMENTS

| | | | |
|---|---|---|---|
| 3,001,169 | 9/1961 | Blonder . | |
| 3,199,061 | 8/1965 | Johnson . | |
| 3,206,540 | 9/1965 | Cohen | 439/578 |
| 3,208,033 | 9/1965 | Blonder . | |
| 3,391,380 | 7/1968 | Robinson et al. . | |
| 3,587,033 | 6/1971 | Brorein et al. . | |
| 3,601,766 | 8/1971 | Alibert | 439/394 |
| 3,845,453 | 10/1974 | Hemmer | 439/578 |
| 3,966,292 | 6/1976 | Schultz | 439/578 |
| 4,291,936 | 9/1981 | Oldfield et al. | 439/578 |
| 4,307,926 | 12/1991 | Smith . | |
| 4,355,857 | 10/1982 | Hayward | 439/578 |
| 4,421,377 | 12/1983 | Spinner . | |
| 4,553,806 | 11/1985 | Forney, Jr. et al. . | |
| 4,979,911 | 12/1990 | Spencer . | |

OTHER PUBLICATIONS

Radio Shack 1992 Catalog, No. 472, p. 148, "Solderless F-59," Item No. 278-215.

*Primary Examiner*—Joseph H. McGlynn

*Attorney, Agent, or Firm*—Samuels, Gauthier & Stevens

[57] ABSTRACT

An end connector for connecting a coaxial cable to a port having a tubular body with front and rear end portions, a cable attachment section associated with the rear end portion for attaching the connector to the cable, and a port attachment section associated with the front end portion for attaching the connector to the port. The port attachment means includes a split ferrule defining a plurality of partially cylindrical resilient fingers, the fingers having inward arcuate projections defining a circumferential ridge adapted to engage the port. The split ferrule defines an inner surface which is inwardly tapered to enhance port to connector contact. A locking sheath is disposed about the front end portion of the tubular body and is adapted to engage an outer surface of the split ferrule so as to restrict the resiliency of the resilient fingers. The attachment section includes an interiorly threaded portion of the tubular body which is preceded by a non-threaded interior portion of the tubular body that is adjacent a rear end opening at the rear end portion of the tubular body.

13 Claims, 2 Drawing Sheets

COAXIAL CABLE END CONNECTOR

BACKGROUND OF THE INVENTION

The invention relates to end connectors used to connect cables to equipment ports, terminals or the like. The invention is particularly useful in, although not limited to, end connectors for coaxial cables in the cable television industry.

The conventional coaxial cable usually consists of a centrally located inner electrical conductor surrounded by and spaced inwardly from an outer electrical conductor. A dielectric insulator is interposed between the inner and outer conductors, with the outer conductor being surrounded by a protective dielectric jacket. The outer conductor can comprise a sheath of fine braided metallic strands, a metallic foil, or multiple layer combinations of either or both.

The conventional end connector is generally tubular in configuration, with a front end which is adapted to attach to equipment ports or terminals, and with a rear end adapted to receive and attach to the cable. Examples of such end connectors are described in U.S. Pat. Nos. 4,990,106 and 5,073,129, of the common assignee, and incorporated herein by reference.

Conventional end connectors are typically crimped to the cable with special tools and/or procedures, then threaded to a mating signal port. However, the typical consumer will not invest in the proper crimping tools or procedures for the few connections required. In addition, the consumer usually will not thread the end connector completely onto the port, a task which requires five to six full turns for a complete and proper connection, thus creating a situation for possible signal loss.

In order to make the end connectors more user friendly, F-connectors or friendly connectors, which are adapted to push on rather than thread on the signal ports, have been presented. These push on type end connectors typically utilize a split ferrule configuration which includes a plurality of resilient fingers that enable relatively easy connection and disconnection of the end connector to the signal port. Furthermore, end connectors have been developed for easy attachment to cables by utilizing an interiorly threaded portion so that the cable may be threaded into the end connector and provide an electrical connection to the outer conductive element of the cable. This so-called twist on feature thus precludes the need for crimping or soldering of the end connector to the cable.

Certain disadvantages are also associated with end connectors that use the push on and twist on features. For example, the push on split ferrule may be disengaged from the signal port in situations where the cable is pulled or is subject to movement. In addition, signal loss may occur if the push on split ferrule is not completely engaged with the port. With respect to the twist on attachment of the end connector to the cable, it may be awkward for the user to guide the prepared cable to the interiorly threaded portion in order to start the threading of the cable by the end connector. Furthermore, the exposed metallic braid or foil of the prepared cable may become entangled or bunched so as to inhibit the threading of the cable by the end connector.

The principal objective of the present invention is to provide an improved end connector designed to insure relatively effortless and precise connections of the end connector to the signal port, and to provide easy connection of the end connector to the prepared cable.

SUMMARY OF THE INVENTION

An end connector for connecting a coaxial cable to a port, comprising a tubular body having front and rear end portions, cable attachment means associated with the rear end portion for attaching the connector to the cable, and port attachment means associated with the front end portion for attaching the connector to the port. In one embodiment, the port attachment means comprises a split ferrule defining a plurality of partially cylindrical resilient fingers, the fingers having inward arcuate projections defining a circumferential ridge adapted to engage the port. The split ferrule, in one aspect of the invention, comprises an open end and a partially enclosed end, and has a plurality of longitudinal slits from the open end to a base end defining the plurality of partially cylindrical resilient fingers, the split ferrule defining an inner surface which is inwardly tapered from a first portion proximate to the base end of the slits to a second portion proximate to the partially enclosed end of the split ferrule.

Another embodiment of the end connector of the present invention comprises a sheath disposed about the front end portion of the tubular body, the sheath adapted to engage an outer surface of the split ferrule so as to restrict the resiliency of the resilient fingers.

In a further embodiment of the end connector of the present invention, the cable attachment means comprises an interiorly threaded portion of the tubular body which is preceded by a nonthreaded interior portion of the tubular body that is adjacent a rear end opening at the rear end portion of the tubular body.

DESCRIPTION OF THE ILLUSTRATED EMBODIMENTS

Figure 1:
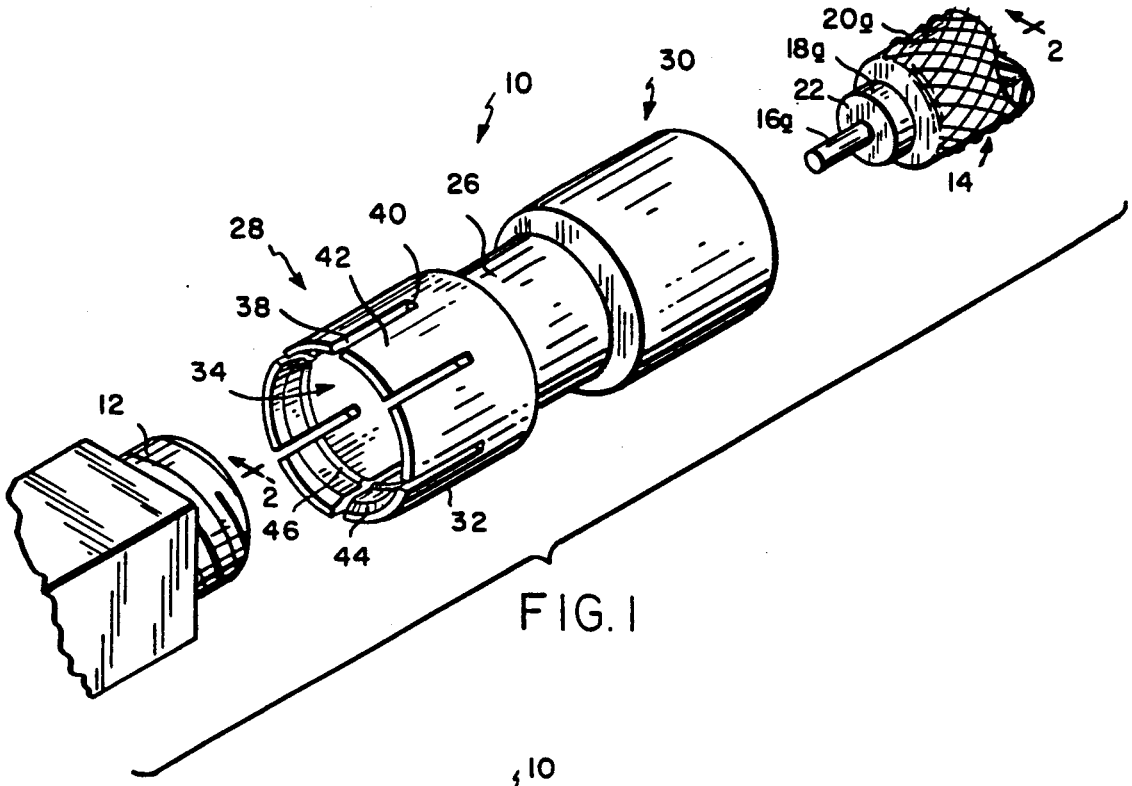
FIG. 1 is an exploded perspective view showing a conventional signal port, an end connector in accordance with the present invention, and end of a conventional coaxial cable which has been prepared for insertion into the end connector.

With reference initially to FIGS. 1-5, an end connector in accordance with the present invention is shown at 10 between a conventional externally threaded equipment port 12 and an end of a conventional coaxial cable 14 which has been prepared to receive the end connector.

In the example herein selected for illustrative purposes, the cable 14 includes an electrical inner conductor 16 surrounded by and spaced inwardly from an electrical outer conductor comprising a layer of metallic foil 18 directly underlying a layer of braided metallic mesh 20. The inner and outer conductors are electrically isolated one from the other by a dielectric insulator 22 interposed therebetween. A dielectric protective covering or jacket 24 surrounds the outer conductor.

The end of the cable is prepared for coupling with the end connector by first removing length $L^1$ of the jacket 24 to thereby expose an end segment 20 a of the braided metallic mesh. The exposed end segment of mesh is then folded back over the jacket as illustrated in the drawings, thus exposing an end segment 18*a* of the metallic foil. Thereafter, a shorter length $L_2$ of the exposed metallic foil segment 18*a* and the underlying dielectric insulator 22 are removed to thereby expose an end segment 16*a* of the inner conductor.

The end connector 10 of the present invention comprises a tubular body 26 having a front end portion 28 and a rear end portion 30. A split ferrule 32 , which is adapted for attachment to the port 12, is provided at the front end portion 28 of the tubular body. The split ferrule comprises an open end 34 or receiving the port 12 and a partially enclosed end 36. The split ferrule 32 also includes a number, e.g. six, of longitudinal slits 38 which extend from the open end of the ferrule to a base end of the slit which is intermediate the open end and the partially enclosed end of the ferrule. The longitudinal slits define a plurality of partially cylindrical resilient fingers 42 which compensate for size tolerances of the port 12.

Each of the resilient fingers 42 is configured to include a slightly tapered portion on the inside surfaces thereof at the open end of the ferrule which also compensates for size tolerances of the port. Furthermore, the resilient fingers 42 are configured to have inward arcuate projections 46 which define a circumferential ridge that is adapted to engage either the flat or , preferably, the threaded surface of the equipment port 12. The circumferential ridge provides resistances to incidental disengagement of the end connector from the port due to applying external forces to the cable. The inward arcuate projections may be configured as a radial or triangular protuberance, or as a ramp and edge projection as illustrated most clearly in FIG. 5.

The inner surface of the split ferrule 32 includes an inwardly tapered portion 48 which is defined between the base end 40 of the longitudinal slits 38 and the partially enclosed end 36 of the ferrule. The inwardly tapered portion 48 allows for metal to metal contact between the ferrule 32 and the port 12 when they become engaged, thus providing a solid contact which will prevent signal loss.

The front end portion 28 also is provided with a through chamber 50 for communication with the rear end portion of the tubular body. The rear end portion includes a rear end opening 52 for receiving the prepared cable 14, and further defines a slightly tapered portion 54 which leads to an interior non-threaded chamber 56 which defines a smooth interior surface 58.

An interiorly threaded portion 60 is defined by the tubular body disposed between the non-threaded chamber 56 and the through chamber 50 leading to the front end portion 28 and ferrule 32. An inwardly tapered portion 62 is provided to lead the threaded portion 60 to the through chamber.

The tapered portion 54 and the smooth interior surface 58 of the non-threaded chamber 56 serve initially to guide the prepared cable 14 for connection to the end connector. More importantly, the non-threaded chamber serves to cover the exposed metallic braided mesh of the prepared cable so that the user is not exposed to the fine sharp wire ends during the connection process. In addition, the metallic braided mesh may become lumped and thus impede entry of the cable into the threaded portion 60 and possibly cause damage to the cable. The interior surface 58 functions to smooth out the metallic braided mesh in order to prevent tearing of same and to enhance the ease of connection to the cable.

After the cable has entered the non-threaded chamber 56, the cable is threaded into the interiorly threaded portion 60. By twisting the cable into the threaded portion, the cable is drawn by the threaded action from the end connector as it creates a mating thread with the pliable material of the jacket 24. The thread crests are preferably sharp enough to penetrate into the surface of the cable jacket and yet not fracture. The pliable material of the jacket flows into the threads to provide an axial holding force on the cable. The end connector is threaded onto the cable until the exposed segment 16*a* of the inner conductor protrudes slightly beyond the open end 34 of the split ferrule 32, and the dielectric insulator portion 22 an end segment 18*a* are received within the through chamber 50.

Figure 6:
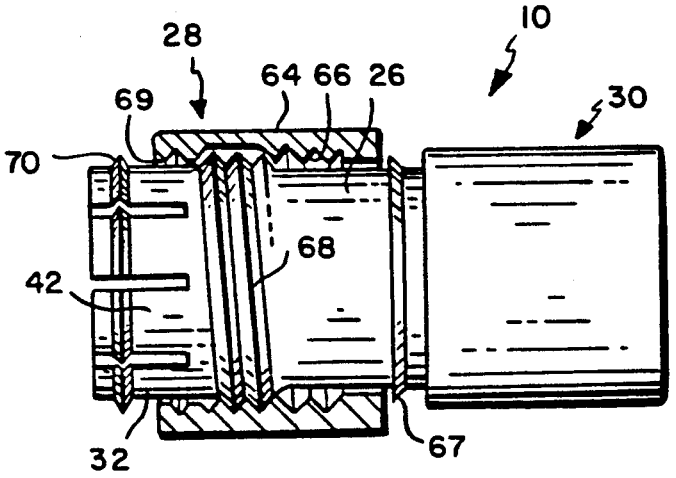
FIG. 6 is a side view of an alternate embodiment of the end connector with an external sheath in an unlocked position.
Figure 7:
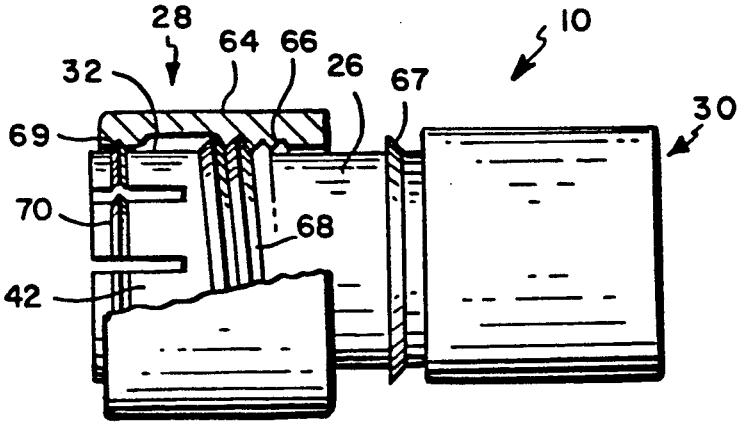
FIG. 7 is a side view of the alternate embodiment of the end connector with the external sheath in a locked position.

With reference now to FIGS. 6 and 7, an alternate embodiment of the end connector according to the present invention is described. The end connector 10 as previously described is further provided with an external locking sheath 64 disposed about the front end portion 28. The locking sheath is configured with an interiorly threaded surface 66 which is threadingly engaged with a threaded portion 68 provided on the outer surface of the split ferrule 32. The locking sheath 64 is axially displaced from an unlocked position when abutting stop member 68 as illustrated in FIG. 6, to a locked position as illustrated in FIG. 7. The locked position occurs by rotating the sheath over the ferrule 32 until an interior circumferential locking channel 69 grasps an outwardly projected circumferential locking ring which is defined by outwardly arcuate projections disposed on each of the resilient fingers 42 of the ferrule. When the sheath is in the locked position as illustrated in FIG. 7, an inwardly directed force applies a radial pressure to the fingers of the ferrule so as to enhance the grasping pressure on the port 12. Both the interiorly threaded surface 66 of the sheath 64 and the threaded portion 68 of the ferrule 32 are configured to require a minimum number of rotations to reach the locked position.

Figure 2:
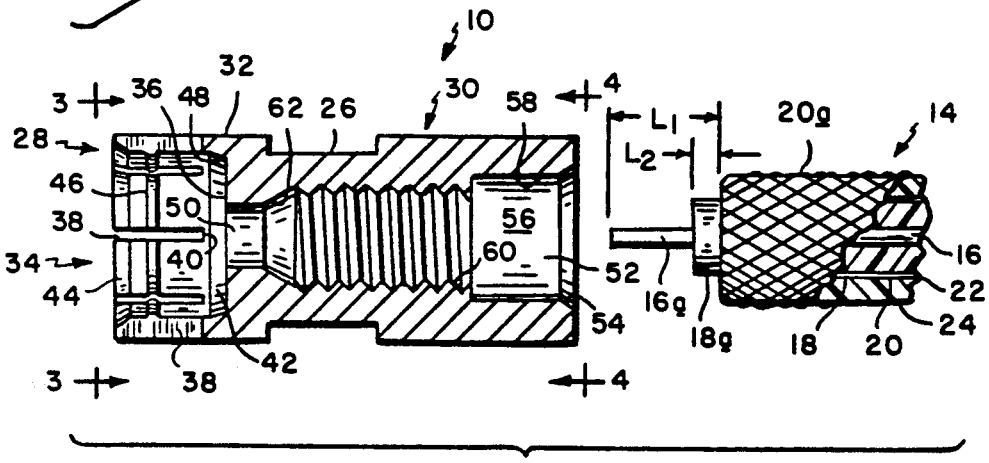
FIG. 2 is a sectional view on an enlarged scale taken along line 2—2 of FIG. 1.
Figure 3:
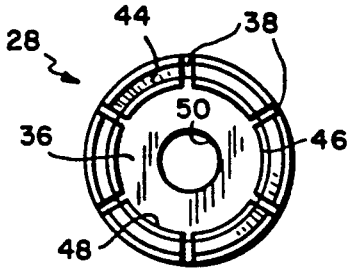
FIG. 3 is a sectional view taken along line 3—3 of FIG. 2.
Figure 4:
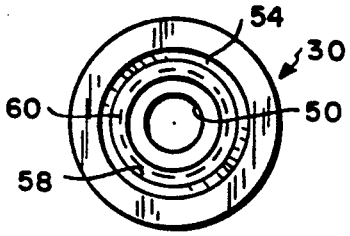
FIG. 4 is a sectional view taken along line 4—4 of FIG. 2.
Figure 5:
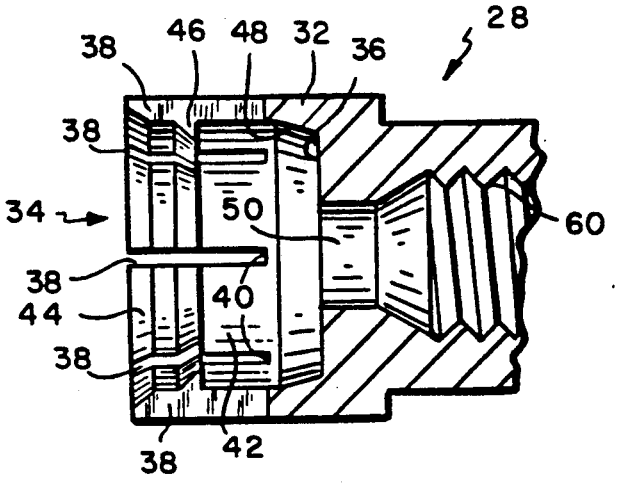
FIG. 5 is an enlarged sectional view showing a portion of the split ferrule at the front end portion of the end connector illustrated in FIG. 2.

It will be appreciated by those of skill in the art, that various modifications and combinations of the front and rear end portions of the described end connector are considered within the scope of the present invention For example, a further embodiment of the present invention provides an end connector with a front end portion with the split ferrule with or without the locking sheath at the front end portion as described in FIGS. 2 and 6 with a conventional crimping section for attachment to the cable at the rear end portion or a crimping rear end portion as described in U.S. Pat. Nos. 4,990,106 and 5,073,129, of the common assignee. A still further embodiment of the present invention provides an end connector with a conventional threaded nut for threading the end connector onto the port at the front end portion and a rear end portion which includes the threaded portion 60 and the non-threaded chamber 56 as described with reference to FIG. 2.

What is claimed is:

1. An end connector for connecting a coaxial cable to a port, comprising:

a tubular body having front and rear end portions;

cable attachment means associated with said rear end portion for attaching said connector to said cable; and port attachment means associated with said font end portion for attaching said connector to said port, said port attachment means comprising a split ferrule having an open end and a partially enclosed end, said split ferrule having a plurality of longitudinal slits extending from said open end to an intermediate region to thereby define a plurality of resilient fingers, said split ferrule defining an inner surface which is inwardly tapered from a first portion proximate to said intermediate region to a second portion proximate to said partially enclosed end of said split ferrule, wherein said inwardly tapered surface is configured to contact the front end portion of said port so as to prevent signal loss between said port and said end connector.

2. The end connector of claim 1, wherein said fingers include inward arcuate projections defining a circumferential ridge adapted to engage said port.

3. The end connector of claim 1, further comprising a sheath disposed about said front end portion of said tubular body, said sheath adapted to engage an outer surface of said split ferrule so as to restrict the resiliency of said resilient fingers.

4. The end connector of claim 1, wherein said cable attachment means comprises an interiorly threaded portion of said tubular body which is preceded by a non-threaded interior portion of said tubular body that is adjacent a rear end opening at said rear end portion of said tubular body.

5. An end connector for connecting a coaxial cable to a port, comprising:

a tubular body having front and rear end portions;

cable attachment means associated with said rear end portion for attaching said connector to said cable;

port attachment means associated with said front end portion for attaching said connector to said port, said port attachment means comprising a split ferrule defining a plurality of resilient fingers; and a sheath disposed about said front end portion of said tubular body, said sheath being threadingly engaged with an outer surface of said split ferrule so as to be axially displaced along said ferrule between an unlocked position and a locked position in which said sheath contacts said fingers, wherein said sheath is adapted to restrict the resiliency of said resilient fingers when engaged in said locked position.

6. The end connector of claim 5, wherein said fingers include inward arcuate projections defining a circumferential ridge adapted to engage said port.

7. The end connector of claim 5, wherein said port attachment means comprises a split ferrule, said split ferrule including an open end and a partially enclosed end, and having a plurality of longitudinal slits from said open end to an intermediate region to thereby define said plurality of resilient fingers, said split ferrule defining a inner surface which is inwardly tapered from a first portion proximate to said intermediate region to a second portion proximate to said partially enclosed end of said split ferrule.

8. The end connector of claim 5, wherein said cable attachment means comprises an interiorly threaded portion of said tubular body which is preceded by a non-threaded interior portion of said tubular body that is adjacent a rear end opening at said rear end portion of said tubular body.

9. An end connector for connecting a coaxial cable to a port, comprising:

a tubular body having a front end portion and a rear end portion with a rear end opening;

port attachment means associated with said front end portion for attaching said connector to said port; and cable attachment means associated with said rear end portion for attaching said connector to said cable, said cable attachment means comprising an interiorly threaded portion of said tubular body which is preceded by both a non-threaded interior tubular chamber portion of said tubular body and a tapered portion that is adjacent said rear end opening.

10. The end connector of claim 9, wherein said port attachment means comprises a split ferrule, said split ferrule including an open end and a partially enclosed end, and having a plurality of longitudinal slits from said open end to an intermediate region to thereby define said plurality of resilient fingers, said split ferrule defining an inner surface which is inwardly tapered from a first portion proximate to said intermediate region to a second portion proximate to said partially enclosed end of said split ferrule.

11. The end connector of claim 10, wherein said fingers include inward arcuate projections defining a circumferential ridge adapted to engage said port.

12. The end connector of claim 10, further comprising a sheath disposed about said front end portion of said tubular body, said sheath adapted to engage an outer surface of said split ferrule so as to restrict the resiliency of said resilient fingers.

13. The end connector of claim 12, wherein said fingers include outward arcuate projections defining a circumferential ridge adapted to engage said sheath in said locked position.

* * * * *